US008646641B2

(12) United States Patent
Moir

(10) Patent No.: US 8,646,641 B2
(45) Date of Patent: Feb. 11, 2014

(54) STORAGE TANK FOR FLUIDS

(75) Inventor: Neil Andrew Moir, Aberdeen (GB)

(73) Assignee: Swire Oilfield Services Limited, London (GB)

( * ) Notice: Subject to any disclaimer, the term of this patent is extended or adjusted under 35 U.S.C. 154(b) by 207 days.

(21) Appl. No.: 13/055,061

(22) PCT Filed: Jul. 17, 2009

(86) PCT No.: PCT/GB2009/050878

§ 371 (c)(1), (2), (4) Date: Jan. 20, 2011

(87) PCT Pub. No.: WO2010/010377

PCT Pub. Date: Jan. 28, 2010

(65) Prior Publication Data

US 2011/0121003 A1 May 26, 2011

(30) Foreign Application Priority Data

Jul. 21, 2008 (GB) ..... 0813314.2

(51) Int. Cl.
*B65D 8/08* (2006.01)

(52) U.S. Cl.
USPC ..... 220/23.91; 220/4.13; 220/647; 206/386

(58) Field of Classification Search
USPC ..... 220/23.91, 565, 1.5, 4.12, 4.13, 647, 220/646; 206/386; 222/185.1
See application file for complete search history.

(56) References Cited

U.S. PATENT DOCUMENTS 3,115,281 A 12/1963 Somme
3,162,331 A * 12/1964 Hutchins et al. ..... 222/184
3,407,971 A 10/1968 Oehler
4,182,254 A * 1/1980 Secord ..... 114/74 A
4,398,653 A 8/1983 Daloisio
4,782,973 A 11/1988 Wiese
4,895,272 A * 1/1990 De Benedittis et al. ..... 220/745
5,292,012 A 3/1994 Davis et al.

(Continued)

FOREIGN PATENT DOCUMENTS

DE 9206686 9/1992
DE 4425630 10/1995

(Continued)

*Primary Examiner* — Stephen Castellano

(74) *Attorney, Agent, or Firm* — Daniel N. Lundeen; Lundeen & Lundeen PLLC

(57) ABSTRACT

The invention relates to a tank for storing fluid. In one embodiment, a tank (10) for storing fluids is disclosed, the tank comprising a vessel (12) for receiving and storing fluid, and a reinforcing structure (14) for the vessel. The reinforcing structure is located externally of the vessel. The vessel has a generally quadrilateral shape in plan view, and a base (16) which is generally dish-shaped, with an outlet (18) located in a position which facilitates discharge of the fluid from the vessel. In providing a tank having a vessel which is generally quadrilateral shape in plan view, the tank offers benefits over prior cylindrical tanks in terms of maximizing the use of available storage space on a ship, or on a vehicle used to transport the tank. Additionally, in providing a tank having a vessel which has a base that is generally dish-shaped, the tank offers improvements over prior quadrilateral shape tanks. In particular, the tank may be cheaper and easier to construct; may be capable of supporting higher pressures; and/or makes better use of available storage space, due to the curved nature of the base.

20 Claims, 11 Drawing Sheets

(56) References Cited

U.S. PATENT DOCUMENTS

| | | | | |
|---|---|---|---|---|
| 5,564,588 | A * | 10/1996 | Reese | 220/565 |
| 2006/0032854 | A1 * | 2/2006 | Schutz | 220/562 |
| 2007/0199937 | A1 * | 8/2007 | Schutz | 220/23.91 |

FOREIGN PATENT DOCUMENTS

| | | | |
|---|---|---|---|
| DE | 19802307 | A * | 1/1998 |
| EP | 178136 | | 4/1986 |
| EP | 0659652 | | 6/1995 |
| FR | 1016942 | | 11/1952 |
| FR | 1479200 | | 4/1967 |
| FR | 2667295 | | 4/1992 |
| FR | 2734551 | | 11/1996 |
| GB | 2393174 | | 3/2004 |
| WO | 01/70597 | | 9/2001 |
| WO | 2006021783 | | 3/2006 |

* cited by examiner

DETAIL I

DETAIL J

DETAIL K

DETAIL L

PARTIAL SECTION M - M

PARTIAL SECTION N - N

PARTIAL SECTION O - O

STORAGE TANK FOR FLUIDS

The present invention relates to a tank for storing fluid. In particular, but not exclusively, the present invention relates to a tank which includes a vessel for receiving and storing the fluid, in which the vessel is generally quadrilateral shape in plan view.

Many different types of tanks for storing fluid exist. These include tanks which are designed for storing hazardous fluids, which may include noxious chemicals. One particular use for tanks of this type is in the storage and transportation of fluids for use in the oil and gas exploration and production industry. For example, the tanks can be used to transport oilfield chemicals, which may be downhole treatment fluids such as methanol or biocides.

Tanks of this type are intended to be charged with the fluid in question onshore and then transported offshore on a ship to the site where the fluid is required. The tanks are typically handled fairly roughly during filling and transportation, using cranes and other lifting gear, and must therefore be designed to withstand this treatment. Furthermore, as the tanks are designed for transport by ship, the tanks must meet strict safety guidelines imposed by the International Maritime Organisation (IMO). Amongst other things, the relevant standards require that the tanks be capable of supporting fluid pressurised to a specified level above atmospheric without rupture or undue deformation.

Tanks having cylindrical fluid storage vessels are able to support high pressures, and can readily be used for transporting fluids of the type described above. However, the cylindrical tanks do not make good use of available storage space on a transport ship, offshore rig or platform. This is because the vessels are typically mounted within a reinforcing structure which has a square or rectangular footprint. The circular cross-section of the cylindrical vessels thus represents a significant waste of space compared to the total volume which the tank takes up on the ship. Consequently, the use of such tanks does not represent the best use of available cargo or deck space.

As a result, different types of tanks have been developed. These include tanks having vessels which are generally quadrilateral in plan view, which allow for more efficient use of available cargo space. However, such tanks do not have the same inherent strength as cylindrical tanks. Consequently, the reinforcing framework associated with such tanks is typically required to support a higher degree of loading, and is therefore of a comparatively greater weight and more complex to manufacture, these factors adding to manufacturing and handling costs.

Also, discharging the fluid from quadrilateral tanks, and indeed cleaning of the tanks, can be problematic. This is because it is necessary to shape the base of the tank to direct fluid towards a lower discharge point, to allow for adequate drainage. One such type of tank includes a base comprising two plates which incline from opposite outer edges of the tank towards the centre of the tank. A discharge point is provided at the lower apex of the base where the plates meet. Whilst tanks of this type do provide for efficient discharge of fluid, and better use of available cargo space, the requirement to include the inclined plates on the base still represents a loss of available storage space. Also, the requirement to provide a discharge point at the lower apex results in further loss of available storage space, as a sufficient gap must be provided for the connection of appropriate pipework which transports the fluid from the discharge point to the edge of the tank, where discharge is controlled using appropriate valve gear.

Consequently, more complex variations on these types of quadrilateral tanks have been developed. These include tanks with a base having a first plate which is inclined at a first, relatively shallow angle, and a second plate which is inclined at a second, steeper angle. This brings the discharge point closer to an edge of the tank. However, tanks of this type are more costly to manufacture and maintain, and still represent a significant wastage of available storage space. It has also been found that the vessels of tanks of this type can be inherently weak, requiring significant reinforcement including internal bracing for the base of the tank. This adds to the weight of the tank and to manufacturing costs.

It will be appreciated that the above problems may also apply to tanks used for storing fluid utilised in industries other than the oil and gas exploration and production industry.

It is amongst the objects of at least one embodiment of the present invention to obviate or mitigate at least one of the foregoing disadvantages.

Accordingly, the present invention provides a tank for storing fluids, the tank comprising:

a vessel for receiving and storing a fluid; and a reinforcing structure for the vessel, the reinforcing structure located externally of the vessel;

wherein the vessel has a generally quadrilateral shape in plan view;

and wherein the vessel has a base which is generally dish-shaped with an outlet located in a position which facilitates discharge of the fluid from the vessel.

In providing a tank having a vessel which is generally quadrilateral shape in plan view, the tank of the present invention offers similar benefits over prior cylindrical tanks in terms of maximising the use of available storage space on a ship, or indeed on a vehicle used to transport the tank. Additionally however, in providing a tank having a vessel which has a base that is generally dish-shaped, the tank of the present invention offers improvements over prior quadrilateral shape tanks. In particular, the tank of the present invention may be cheaper and easier to construct; may be capable of supporting higher pressures and thus may require less reinforcement (at least associated with the base); and/or makes better use of available storage space, due to the curved nature of the dish-shaped base. This is achieved whilst still providing for good fluid discharge and easy cleaning of the tanks, through appropriate location of the outlet in the base.

It will be understood that the tank may be for storing and transporting fluid. Also, reference is made herein to a tank having a vessel with a base that is generally dish-shaped. The term "dished base" may be used interchangeably therewith.

The generally dish-shaped base may be arcuate or curved.

The base may have a shape which corresponds to or with a surface of a sphere or part of a surface of a sphere. The base may have a constant, or substantially constant, radius of curvature. The radius of curvature may be constant in a direction extending radially from a centre or centroid of the base towards an edge or edges of the base. Thus a degree of curvature of the base may be constant in a radial direction from the centroid, and may be constant in all radial directions. The radius of curvature may be constant in a direction extending around a circumference of the base, that is, along a line or path which extends around the base at a fixed radial distance from a centre or centroid of the base. Thus a degree of curvature of the base may be constant in a circumferential direction. Where the radius of curvature is constant, a geometrical centre of the radius or radii of curvature may be located vertically above the centre or centroid of the base. Alternatively the geometrical centre may be located spaced laterally from the centre or centroid of the base, and thus not located above the centroid. The radius of curvature may be at least 3 m, and may be at least 4 m. The radius of curvature may be no more than 7 m, and may be no more than 6 m. The radius of curvature may be 5 m. This may offer advantages in terms of maximising strength of the tank as against use of available storage space/volume of the vessel.

The base may have a non-constant radius of curvature. The radius of curvature may be non-constant in a direction extending radially from a centre or centroid of the base towards an edge of the base, and thus may vary along the length of the radius. Thus a degree of curvature of the base may be non-constant in a radial direction, and may be non-constant in all radial directions. The base may be parabolic or elliptical in cross-section. The radius of curvature may be non-constant in a direction extending around a circumference of the base, that is, along a line which extends in a circular path at a fixed radial distance from a centre or centroid of the base. Thus a degree of curvature of the base may be non-constant in a circumferential direction.

The base may comprise a first portion of a first radius of curvature and at least one further portion of a further radius of curvature which is different from said first radius of curvature. The first and further portions may have constant or non-constant radii of curvature, in a similar fashion to that described above.

The vessel base may comprise a planar portion or portions.

The vessel may comprise a generally dish-shaped top. The top may be of similar shape to the base, and thus further features of the top may be in common with the above described additional/alternative features of the base. Alternatively, the top may be planar.

Providing a vessel with a dish-shaped base and/or top may offer advantages in terms of maximising the pressure bearing capability of the vessel whilst minimising manufacturing costs and/or weight. In particular, in providing the vessel with a dish-shaped base and/or top, it may not be necessary to provide reinforcing structure specifically for supporting loading on the base and/or top due to the pressure of the fluid contained within the vessel, or at least the amount of reinforcing structure required and/or the weight of any reinforcing structure required can be minimised. This is because the inherent strength afforded by making the base and/or top dish-shape may be sufficiently high that the base and/or top are self-supporting under applied fluid pressure loading.

The vessel may be generally square in plan view, or may be generally rectangular. The vessel may comprise four side walls, which walls may be planar. Alternatively, the walls may be generally dish-shaped.

It will be understood that the vessel is generally quadrilateral in plan view in that the shape of the vessel in cross section, taken in a horizontal plane, is generally quadrilateral.

The outlet may be located at a position which is lowermost of or in the base, and is preferably located at a centre or centroid of the base. A space may be defined between an external surface of the base and the reinforcing structure, and pipework may extend from the outlet through said space to an edge of the vessel, to facilitate discharge of fluid from the vessel. It will be understood that, by providing a generally dish-shaped base, the dimension of the space varies from a minimum dimension at the lowermost portion of the base to a maximum dimension at the edges of the base. By providing a base which is dish-shaped, the total volume of the space may be reduced in contrast, for example, to prior tanks having two angled plates, which may thereby increase the tank volume.

The reinforcing structure may comprise a reinforcing frame, which may be welded to the vessel or which may be adapted to be releasably coupled to the vessel, such as by using suitable releasable fixings. These may comprise an arrangement of nuts, bolts, threaded bores or the like, the vessel and/or frame carrying appropriate flanges or the like for cooperating with the fixings. The reinforcing frame may be adapted to enclose the vessel, and may comprise a base, a top and four sides. The sides may be adapted to be located in abutment with side walls of the vessel, or may be adapted to be arranged relative to the vessel such that the sides of the frame support the side walls of the vessel should the walls expand outwardly, in use, under applied pressure of a fluid contained within the vessel. Thus spaces or spacings may exist between the sides of the frame and the side walls of the vessel prior to charging of a fluid into the vessel. Spaces or spacings may be defined between one or both of the base and the top of the vessel and the corresponding base and top of the frame.

It will be understood that, whilst the base is generally dish-shaped, the base may be quadrilateral in plan view, to correspond to the shape of side walls of the vessel. The side walls of the vessel may each be shaped such that at least part of the lower edge of each side wall overlaps the corresponding edge of the base, and may be quadrilateral in shape. In particular, the curved nature of the base may be such that edges of the base extend up inner surfaces of the side walls. The edges of the base may extend up the inner surface of the side walls to a greatest extent at corner regions of the vessel where two adjacent side walls are connected. Alternatively, the side walls of the vessel may be connected to the base at lower edges of the side walls, and the side walls may be shaped to conform to the shape of the base, the lower edges of the side walls thus being curved or arcuate to permit such connection.

Embodiments of the present invention will now be described, by way of example only, in which.

Figure 1:
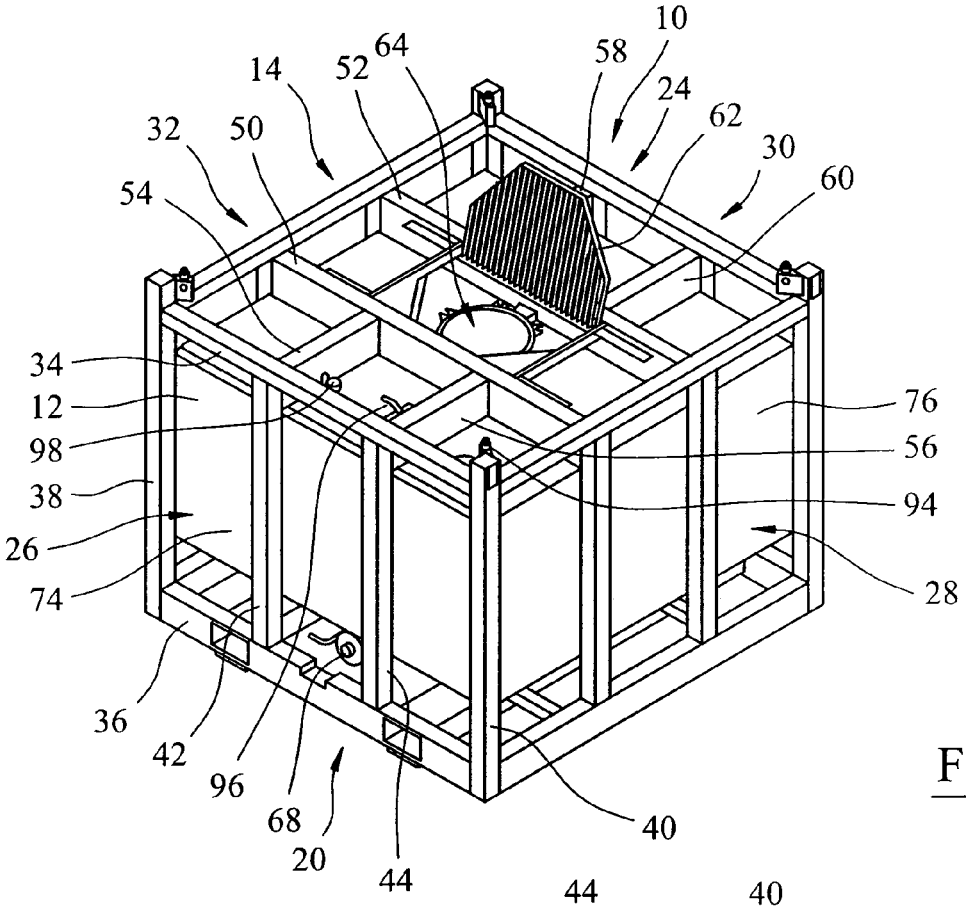
FIG. 1 is a perspective view, taken from above, of a tank for storing fluid in accordance with an embodiment of the present invention.
Figure 2:
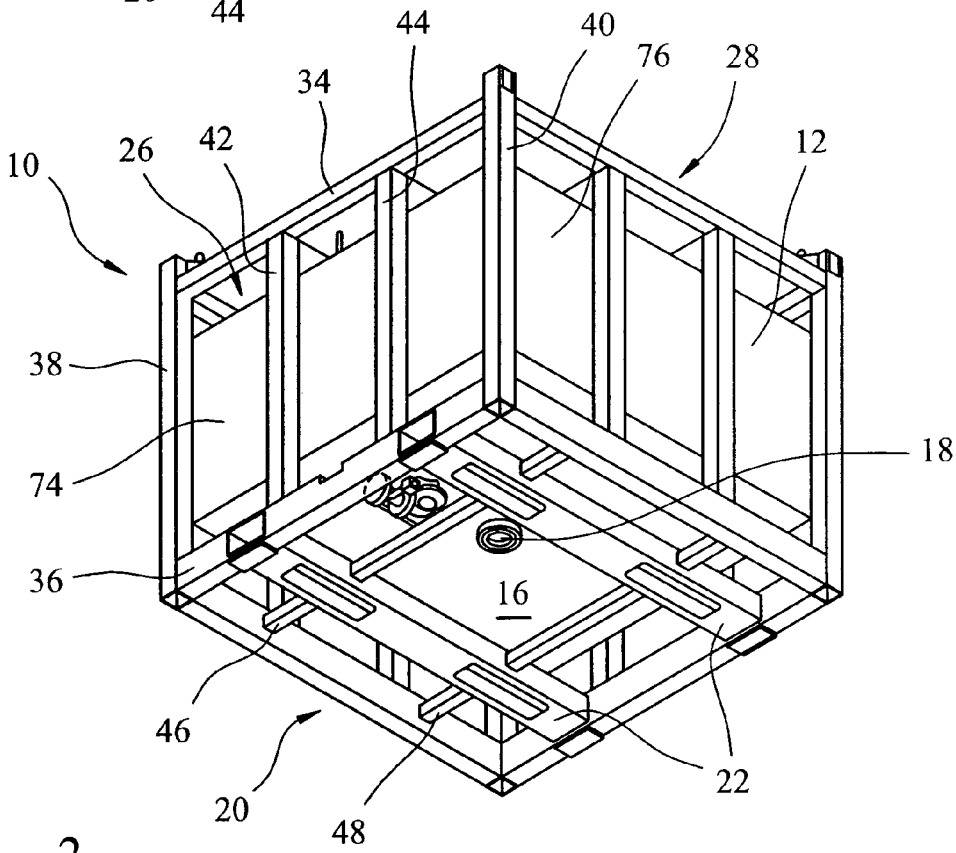
FIG. 2 is a perspective view of the tank of FIG. 1, taken from below.
Figure 3:
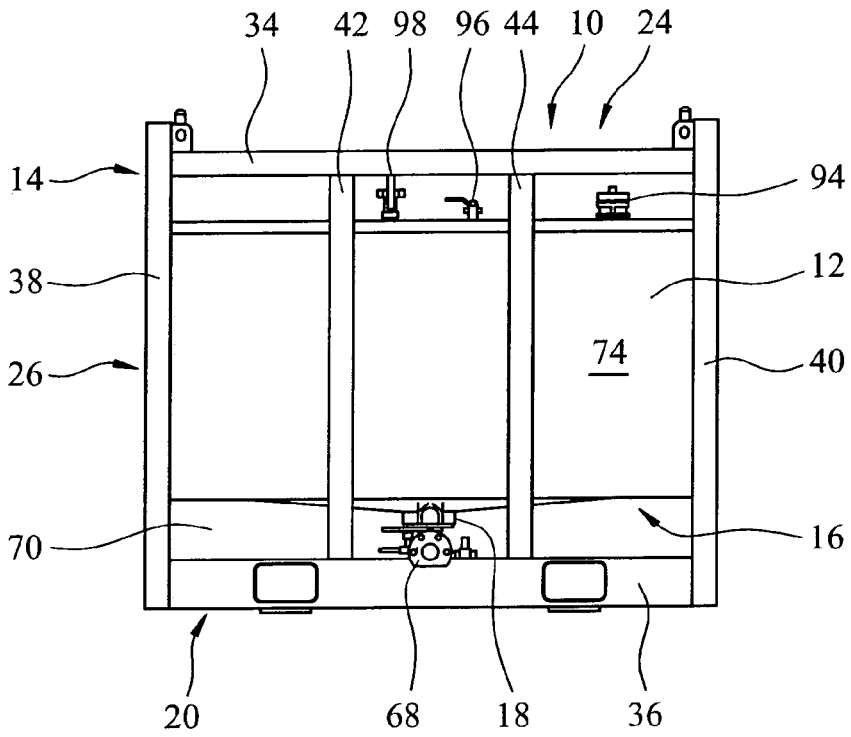
FIGS. 3, 4, 5 and 6 are front, side, rear and plan views, respectively of the tank shown in FIG. 1.
Figure 4:
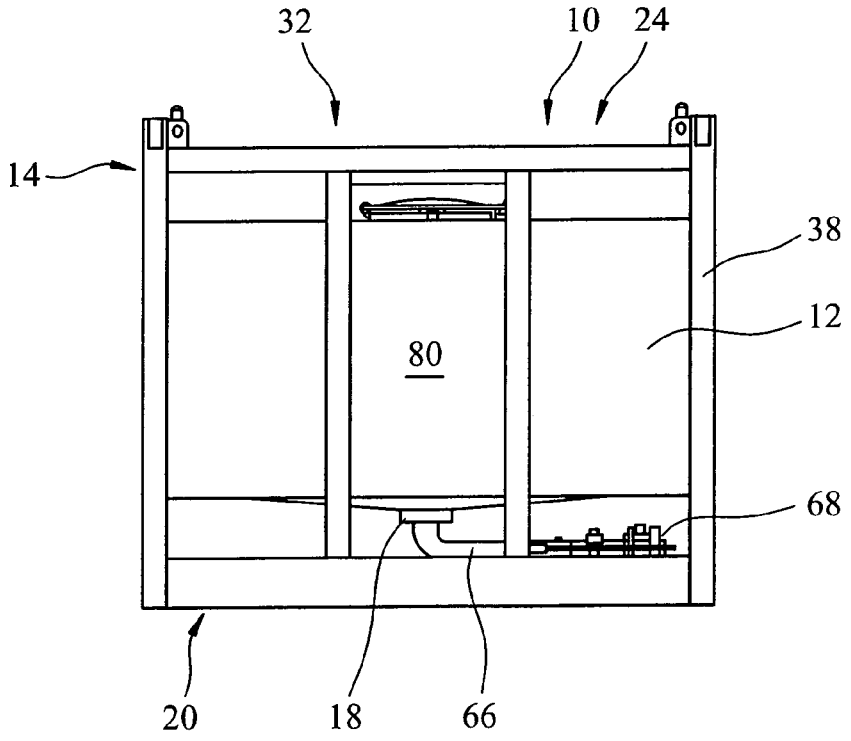
Figure 5:
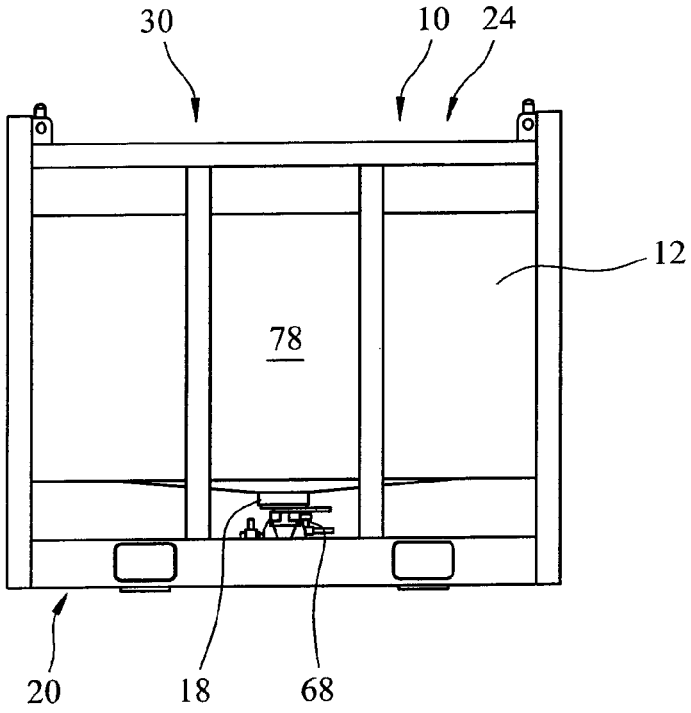
Figure 7:
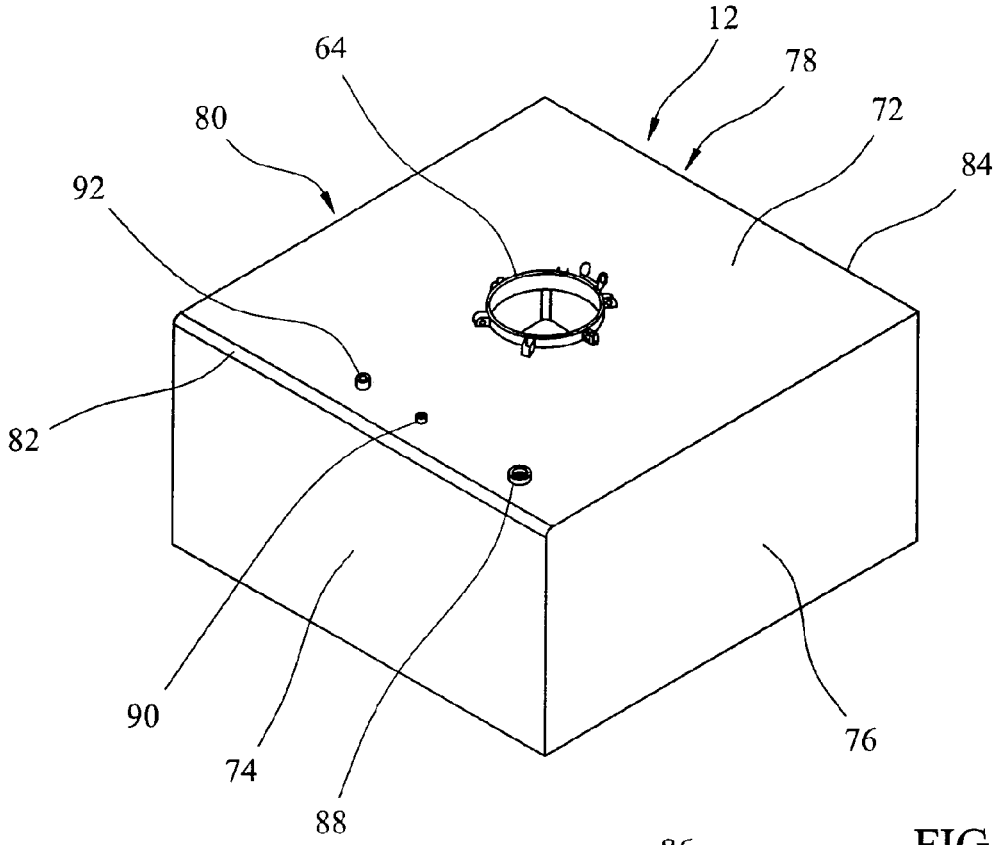
FIG. 7 is a perspective view, taken from above, of a vessel forming part of the tank of FIG. 1.
Figure 8:
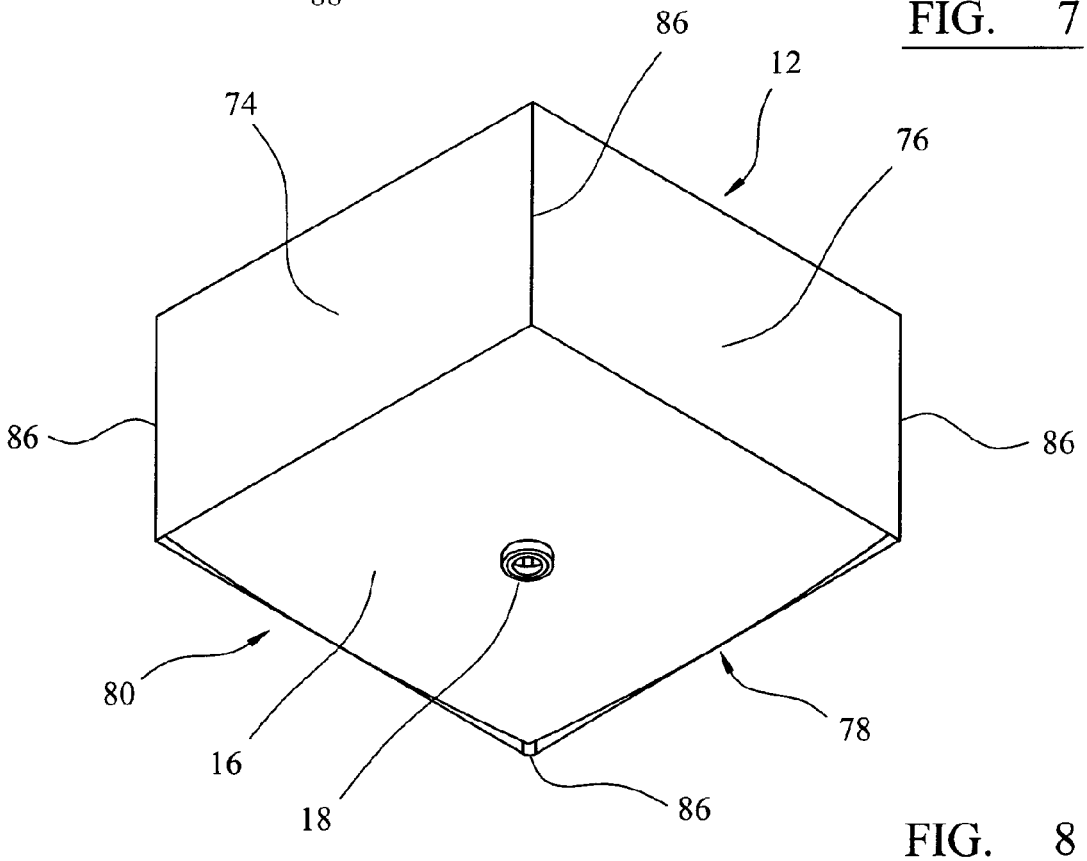
FIG. 8 is a perspective view of the vessel of FIG. 7, taken from below.
Figure 9:
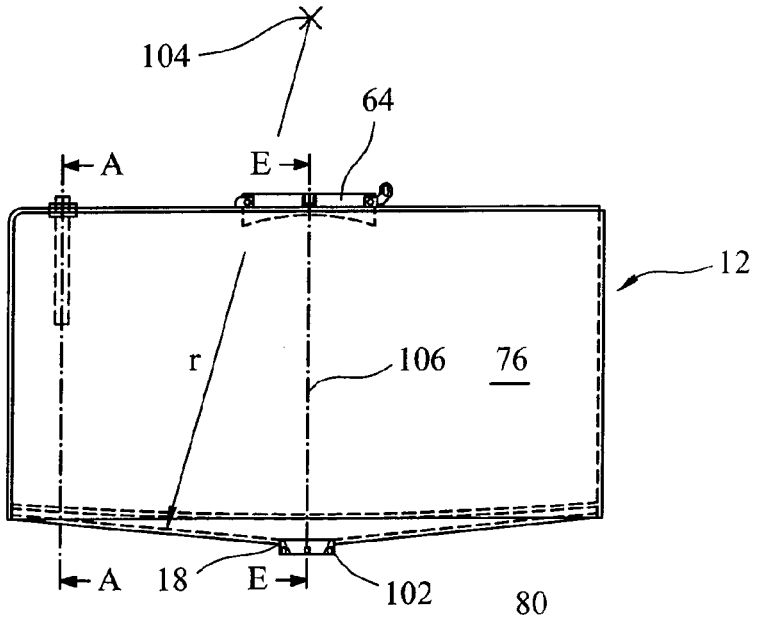
FIGS. 9 and 10 are side and plan views, respectively, of the vessel shown in FIG. 7.

Turning firstly to FIG. 1, there is shown a perspective view, taken from above, of a tank for storing fluid in accordance with an embodiment of the present invention, the tank indicated generally by reference numeral 10. The tank 10 generally comprises a vessel 12 for receiving and storing a fluid, and a reinforcing structure 14 located externally of the vessel 12. The tank 10 is also shown in the perspective view of FIG. 2, which is taken from below, as well as in the front, side, rear and plan views, respectively, of FIGS. 3, 4, 5 and 6. The vessel 12 is shown separately from the reinforcing structure 14 in the perspective view of FIGS. 7 and 8, taken from above and from below respectively. Additionally, the vessel 12 is shown in the side and plan views of FIGS. 9 and 10 and in the cross-sectional views of FIGS. 11 and 12, taken respectively in the direction of the arrows A-A and E-E of FIG. 9. Enlarged views of parts of the vessel 12 are shown variously in FIGS. 13 to 17.

Figure 6:
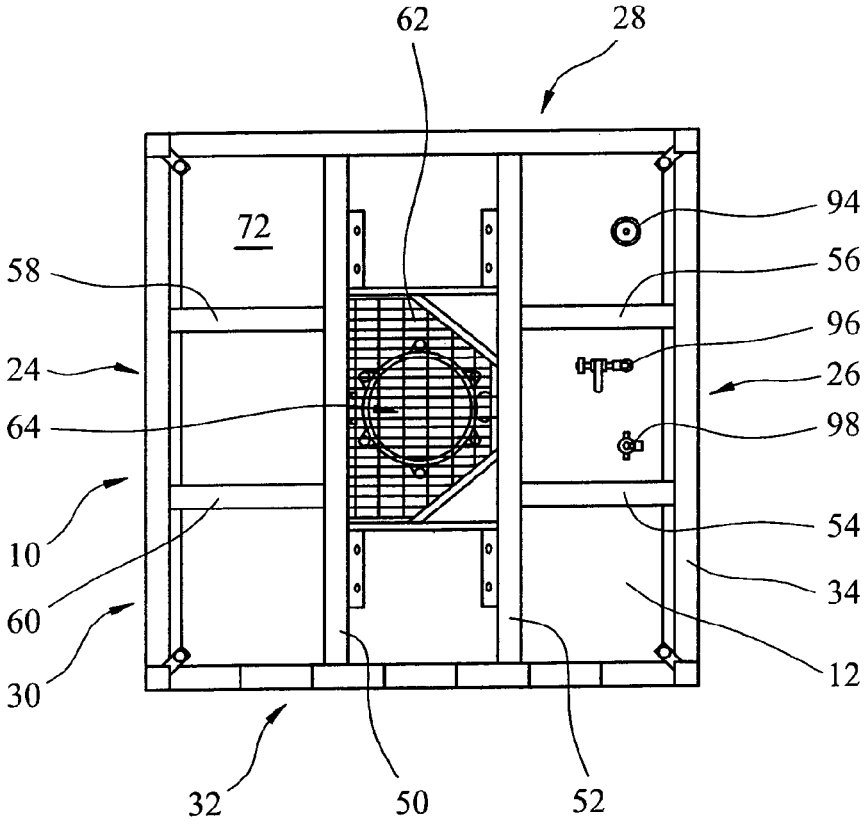
Figure 10:
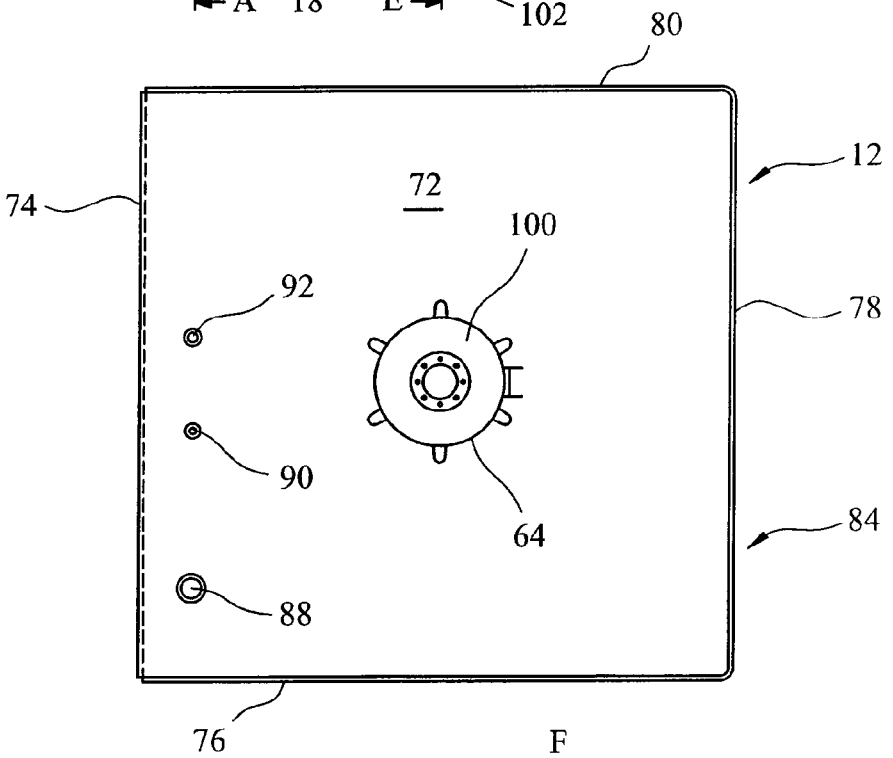
Figure 11:
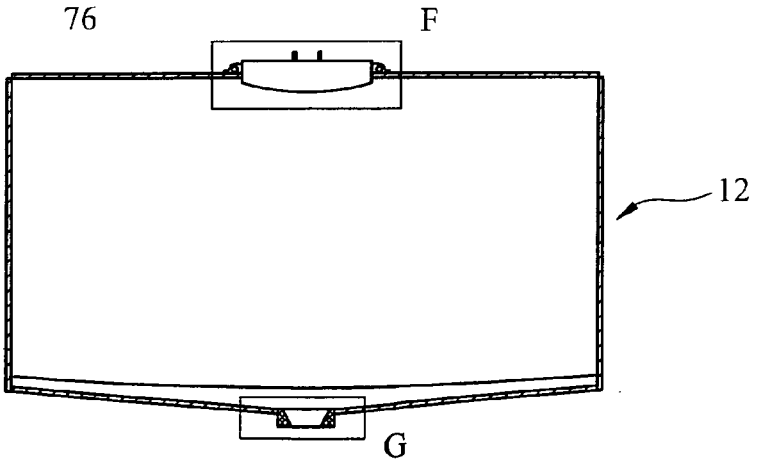
FIG. 11 is a cross-sectional view of the vessel shown in FIG. 7, taken in the direction of the arrows A-A of FIG. 9.
Figure 12:
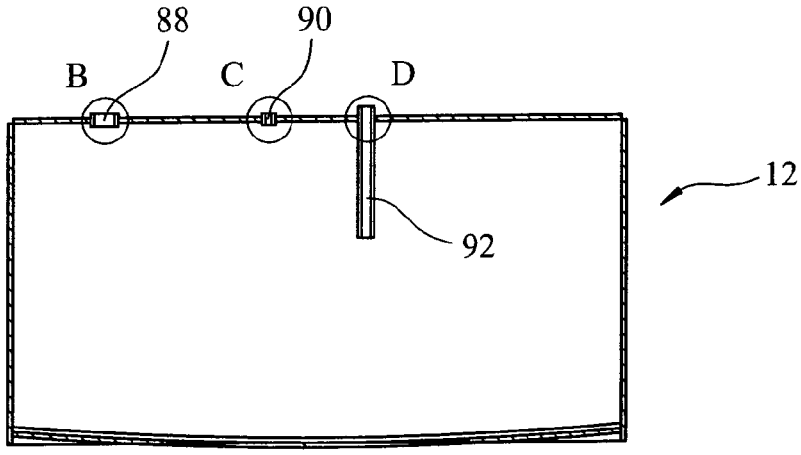
FIG. 12 is a cross-sectional view of the vessel shown in FIG. 7, taken in the direction of the arrows E-E of FIG. 9.
Figure 13:
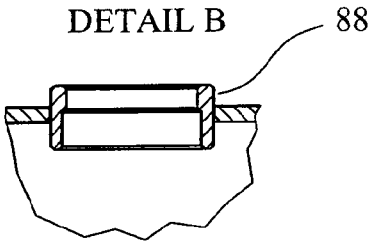
FIGS. 13, 14 and 15 are enlarged views of parts of the vessel shown in the view of FIG. 12.
Figure 14:
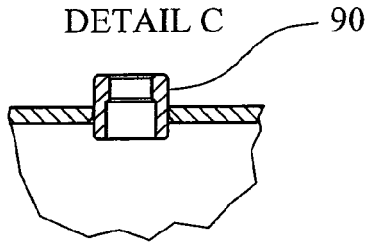
Figure 15:
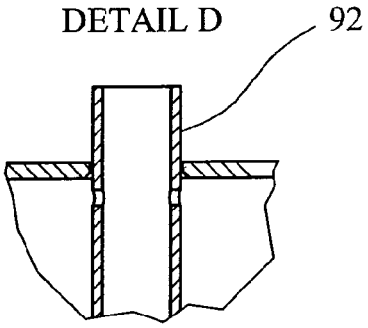
Figure 16:
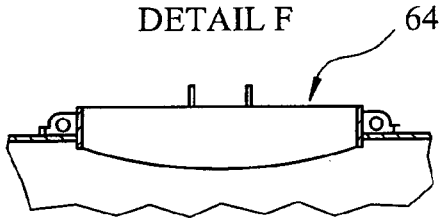
FIG. 16 is a cross-sectional view of the vessel shown in FIG. 7, taken about line E-E of FIG. 9.
Figure 17:
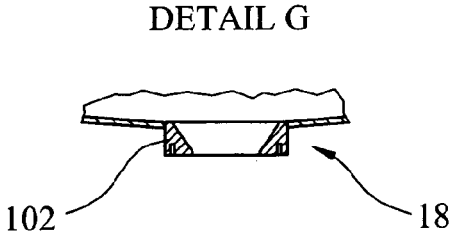
FIG. 17 is an enlarged view of part of the vessel shown in the view of FIG. 11.

As can be seen particularly in FIGS. 6 and 10, the vessel 12 has a generally quadrilateral shape in plan view. In the illustrated embodiment, the vessel 12 is generally square in plan view. The vessel 12 also has a base 16 which is generally dish-shaped as shown in the views of FIGS. 3 to 5, 8, 9, 11 and 12. The base 16 has an outlet 18, best shown in FIGS. 8, 9 and 11, which is located in a position which facilitates discharge of fluid from the vessel 12. The tank 10 will typically be used to transport fluids at atmospheric pressure. However, the tank 10 is capable of containing pressurised fluids; indeed, in order to meet the safety standards imposed by the IMO, the tank 10 must be pressure tested before use.

In providing a tank having a vessel which is generally quadrilateral shape in plan view, the tank of the present invention offers similar benefits over prior cylindrical tanks in terms of maximising the use of available storage space on a ship, or indeed on a vehicle used to transport the tank. In particular, one benefit of using a quadrilateral tank is that almost all of the space within the reinforcing structure can be utilised. Accordingly, in comparison to a tank having a non-quadrilateral vessel storing the same volume of fluid, it is possible to make the tank smaller in height. This offers further advantages including that it facilitates access to man machine interfaces (MMIs) on the tank from deck level. Accordingly, the need for an operator to climb atop the tank can be avoided or at least reduced, such that the tanks are safer to operate. The MMIs may include an air vent and dipstick port on top of the tank, as well as a discharge on the bottom or base. The MMIs may further include a main access manhole, however, general practice is not to open the manhole offshore. The MMIs will be described in more detail below.

Additionally however, in providing a tank having a vessel which has a base that is generally dish-shaped, the tank of the present invention offers improvements over prior quadrilateral shape tanks. In particular, the tank of the present invention may be cheaper and easier to construct; may be capable of supporting higher pressures and thus may require less reinforcement (at least associated with the base); and/or makes better use of available storage space, due to the curved nature of the dish-shaped base. This is achieved whilst still providing for good fluid discharge and easy cleaning of the tanks, through appropriate location of the outlet in the base.

The reinforcing structure 14 takes the form of a frame provided around the vessel 12. The frame 14 both reinforces the vessel 12, and provides a degree of security against puncture of the vessel 12 during storage and handling. Additionally, the reinforcing frame 14 facilitates handling of the tank 10 in that it includes a base 20 having two cross-beams 22 which are hollow and shaped to receive the forks (not shown) of a fork-lift truck. Additionally however, shackles, padeyes or the like may be provided on the frame 14.

The reinforcing frame 14, in addition to the base 20, includes a top 24 and four sides, 26, 28, 30 and 32. The sides 26 and 30 form the front and back of the reinforcing frame 14, respectively. Each of the base 20, top 24 and sides 26 to 32 are of similar construction, being assembled from a series of welded frame members. Each of the sides 26 to 32 are of similar construction, and only the structure of one of the sides, the side 26 shown in FIG. 1, will be described herein. The side 26 includes upper and lower cross-beams 34 and 36, two corner posts 38 and 40 and two bracing posts 42 and 44. The corner posts 38 and 40 are actually shared with the sides 32 and 28, respectively.

In addition to the cross-beams 22, the base 20 of the frame 14 includes two cross-braces 46 and 48. The top 24 includes two main cross-beams 50 and 52, which are welded between bracing posts of the side walls 28 and 32. Cross-braces 54 and 56 extend from the side 26 to the cross-beam 50, whilst similar cross-braces 58 and 60 extend from the side 24 to the cross-beam 52. Typically, grating (not shown) will be provided above the cross-beams 50, 52 and cross-braces 54 to 60 to provide a walkway. A hatch 62 is provided, mounted on the cross-beam 52 and which can be opened to provide access to a manhole 64 in the vessel 12. This facilitates entry into the vessel 12 for inspection, maintenance and/or cleaning purposes.

Typically, the vessel 12 will be welded to the support frame 14, and may be welded to (and thus supported by) the sides 26 to 32 of the frame. Equally, the vessel 12 may be releasably mounted in the frame 14, such as via nut-and-bolt assemblies (not shown) coupling the vessel to structural elements of the frame 14, such as members of the sides 26 to 32.

The vessel outlet 18 is provided at the lowest point of the base 16, to facilitate free drainage of fluid from the vessel 12. A pipe 66 is coupled to the outlet (FIG. 4) and extends towards the side wall 26. Valve gear 68 is provided for controlling fluid discharge. The pipe 66 and valve gear 68 is provided in a space 70 between the external surface of the base 16 and top surfaces of the cross-beams 22 and cross-braces 46, 48 of the base 20 of the reinforcing frame 14. The inherent strength of the vessel base 16, due to its dished shape, allows the tank 10 to be formed without associated bracing specifically for the base 16. This facilitates minimisation of the dimensions of the space 70, and also reduces the weight of the reinforcing frame 14, and thus manufacturing, handling and/or transportation costs.

Referring particularly to FIGS. 7 to 12, in addition to the base 16, the vessel 12 includes a top 72 and side walls 74, 76, 78 and 80. The walls 74 and 78 effectively form front and rear surfaces of the vessel 12, and are provided in one-piece with the top 72. This is achieved by forming a single plate into the required shape, and has the added advantage of providing bevelled edges 82 and 84 at the intersections between the side walls 74, 78 and the top 72.

The top 72 and side walls 74 to 80 are each planar. The top 72 is generally square in shape, whilst the side walls 74 to 80 are generally rectangular. As can be seen particularly in the bottom perspective view of FIG. 8, the dished base 16, through its inherent curvature, extends part way up the internal surfaces of the side walls 74 to 80 from the midpoint of the side walls towards corners 86 of the vessel 12.

The outlet 18 of the dished base 16 is provided at the centre or centroid of the base. A radius of curvature of the base 16 is constant. Accordingly, the radius of curvature is constant in any radial direction from the centroid of the base 16 towards the edges of the base 16. Consequently, the radius of curvature of the base 16 is also constant along circumferential paths centred upon the centroid. Consequently, the base 16 has a shape generally conforming to the surface of a sphere. The radius of curvature of the base 16 will typically be between 3 to 5 meters. This provides a good balance of inherent strength of the base 16 with minimisation of the space 70 between the external surface of the base 16 and the base 20 of the reinforcing frame 14. However, it will be understood that the base 16 may have another suitable radius of curvature depending upon factors including the dimensions of the tank and the balance of the above characteristics which is required.

Various inspection and vessel charging ports (MMIs) are provided in the vessel 12. These include ports 88 and 90 and pipe 92, which are best shown in the cross-sectional view of FIG. 12, and in the enlarged, detail views of FIGS. 13, 14 and 15, respectively. The ports 88 and 90 include appropriate valve gear 94 and 96 (FIG. 1), which facilitates connection of a pressure vacuum valve and an air inlet (not shown) to the vessel 12, for charging the vessel with fluid. Dipstick pipe 92 carries similar valve gear 98, which permits connection of apparatus suitable for inspecting the contents of the vessel 12, and in particular for measuring fluid volume and other desired parameters. The manhole 64 includes a hinged lid 100 which can be opened through the hatch 62 to provide access to the vessel 12. The outlet 18 carries a short connector 102 which is chamfered, to provide good flow characteristics through the outlet 18 and to assist in preventing clogging where relatively viscous fluids are charged into the vessel 12.

In the illustrated embodiment, a geometrical centre 104 (FIG. 9) of the radius of curvature of the base 16 is shown. The radius of curvature is indicated by the letter "r" shown in the figure. The Geometrical centre 104 is located vertically above the centroid of the base 16, and thus on a central axis 106 of the base 16 and indeed of the vessel 12. The base 16 is therefore symmetrical about the axis 106, and takes the partial spherical form discussed above.

The tank 10 may be designed to be of any suitable volume by appropriate dimensioning of the vessel 12 and the support frame 14. In the illustrated embodiment, the vessel 12 will typically have a capacity of 1000 gallons, but may have a capacity of 500 gallons or may be of another volume. It will be understood that the frame 14 may require a greater or lesser number of frame members where the volume of the vessel is to be greater or smaller than that shown and/or load bearing capacities (and thus dimensions/materials) of the frame members may be varied.

Figures 18, 19, 20, 21:
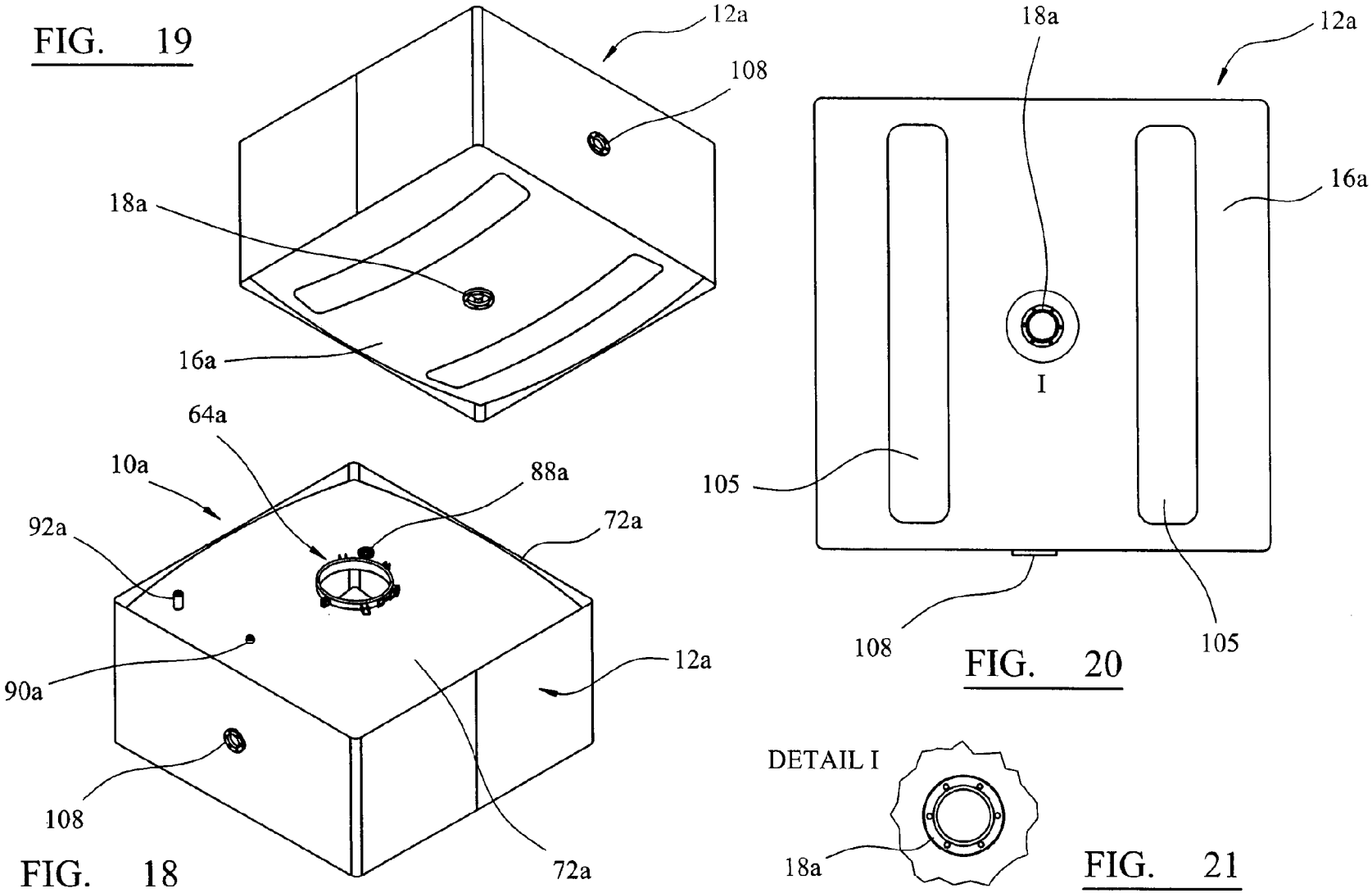
FIG. 18 is a perspective view, taken from above, of a vessel forming part of a tank for storing fluid in accordance with an alternative embodiment of the present invention.
FIG. 19 is a perspective view of the vessel of FIG. 19, taken from below.
FIG. 20 is a bottom view of the vessel shown in FIG. 18.
FIG. 21 is an enlarged view of part of the vessel shown in FIG. 20.

Turning now to FIG. 18, there is shown a perspective view of part of a tank in accordance with an alternative embodiment of the present invention, the tank indicated generally by reference numeral 10*a*. Like components of the tank 10*a* with the tank 10 of FIGS. 1 to 17 share the same reference numerals, with the addition of the suffix "a". In FIG. 18, only a vessel 12*a* of the tank 10*a* is shown. The tank 10*a* additionally includes a reinforcing structure in the form of a reinforcing frame. The reinforcing frame is of similar construction to the frame 14 of the tank 10 shown in FIGS. 1 to 6 and described above, and has therefore been omitted, for ease of illustration.

The vessel 12*a* of similar construction to the vessel 12, save that the vessel 12*a* additionally includes a generally dish-shaped top 72*a*, as best shown in FIG. 18. The dished top 72*a* is of similar construction to a dish-shaped base 16*a* of the vessel 12, shown in the perspective view of FIG. 19, taken from below. Thus the top 72*a* has a similar shape and radius of curvature as the base 16*a*. The base 16*a* itself is of similar construction, and positioning relative to a remainder of the vessel 12*a*, as the base 16. The radius of curvature of the vessel 12*a* is 5 meters. Additionally however, reinforcing plates known as doubler plates or saddles 105 are welded on to the base 16*a*. Although the vessel 12*a* will typically be welded to (and thus supported by) the sides of a frame such as the frame 14, the doubler plates 105 provide additional support for the vessel 12*a*, particularly under load when a pressurised fluid is charged into the vessel. In more detail, support elements (not shown) on a base of the frame will typically be welded to the vessel 12*a* in the region of the doubler plates 105. The doubler plates 105 also provide protection against puncture of the base 16*a*, particularly during manufacture when the vessel 12*a* is lowered into the frame and/or when the support elements are welded to the base 16*a* of the vessel.

Figure 22:
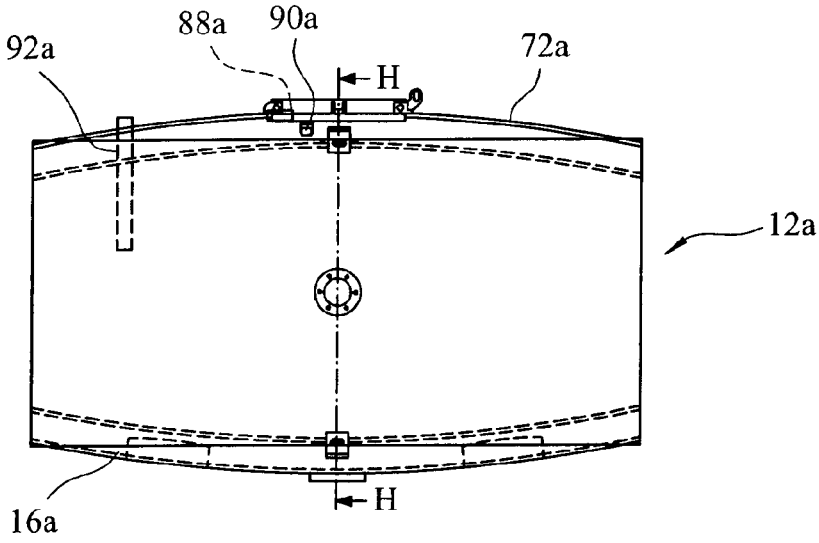
FIGS. 22 and 23 are front and plan views, respectively, of the vessel shown in FIG. 18.
Figure 23:
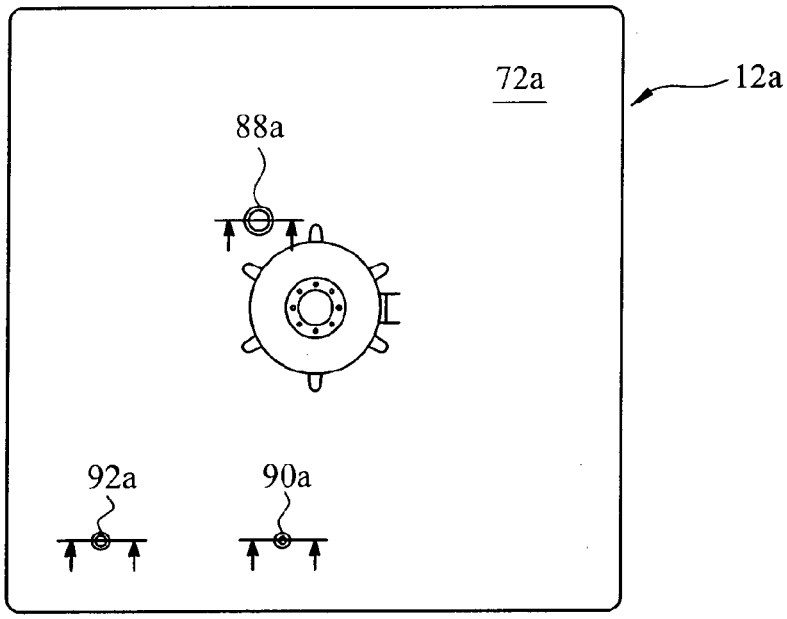
Figure 24:
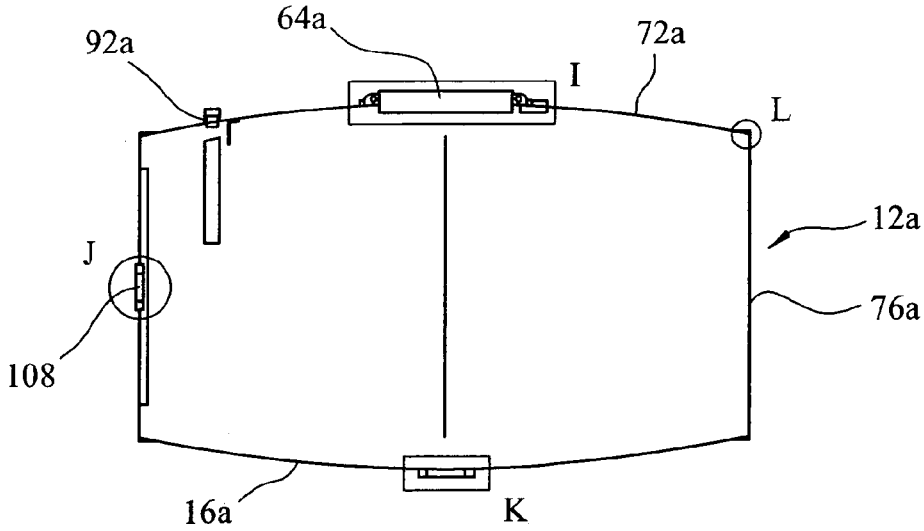
FIG. 24 is a cross-sectional view of the vessel shown in FIG. 18, taken in the direction of the arrows H-H of FIG. 22.
Figure 25:
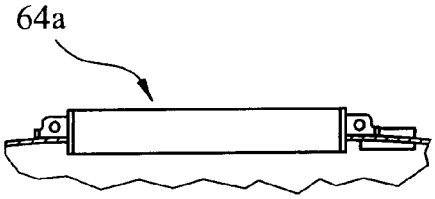
FIGS. 25, 26, 27 and 28 are enlarged views of parts of the vessel shown in FIG. 24.
Figure 26:
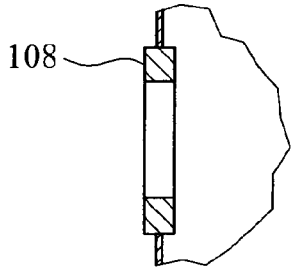
Figure 27:
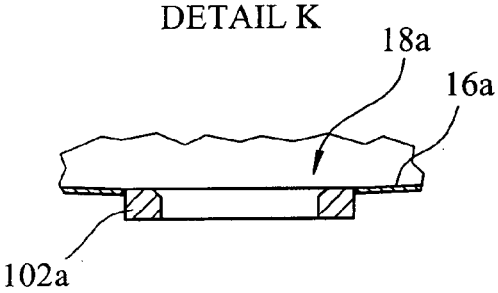
Figure 28:
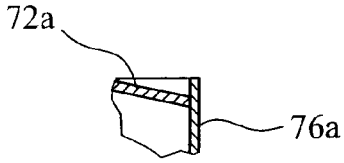
Figure 29:
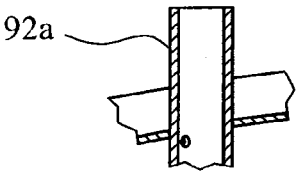
FIGS. 29, 30 and 31 are enlarged, cross-sectional views of parts of the vessel shown in FIG. 18, taken in the direction of the arrows M-M, N-N and O-O respectively, shown in FIG. 23.
Figure 30:
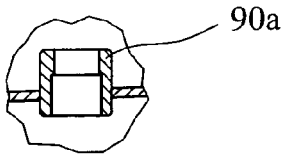
Figure 31:
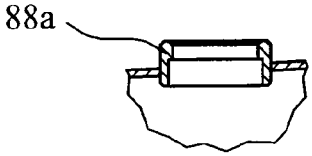

The vessel 12*a* is also shown in the bottom view of FIG. 20, which illustrates the outlet 18*a* in the base 16*a*. The outlet 18*a* is also shown in the enlarged view of FIG. 21. Additionally, the vessel 12*a* is shown in the front and plan views of FIGS. 22 and 23, as well as in the cross-sectional view of FIG. 24, which is taken in the direction of the line H-H of FIG. 22. FIG. 25 is an enlarged view of a manhole 64*a* of the vessel 12*a*, whilst FIG. 26 is a view of a level gauge port 108 of the vessel 12*a*. FIG. 27 shows a connector 102*a* at the outlet 18*a* in the base 16*a*, which is of slightly different profile to the connector 102 of the tank 10 base. The intersection between the top 72*a* and a side wall 76*a* of the vessel 12*a* is shown in the enlarged view of FIG. 28. Finally, FIGS. 29, 30 and 31 show a pipe 92*a*, port 90*a* and port 88*a*, respectively, of the vessel 12.

The structure and method of manufacturing the vessel 12*a* of the tank 10*a*, and indeed the remaining structure of the tank 10*a*, is as described above in relation to the tank 10 of FIGS. 1 to 17.

In providing a vessel 12*a* having both a dished base 16*a* and a dished top 72*a*, the inherent strength of the vessel 12*a* will be higher than that of the vessel 12. This may in turn facilitate a reduction in weight and/or manufacturing costs of the vessel 12*a* and thus of the tank 10*a*, relative to the vessel 12 and tank 10. In particular, the top of a reinforcing structure for the vessel 12*a* may not require to directly support the top 72*a* of the vessel 12*a* under load. Indeed, a space may be provided between the outer surface of the vessel top 72*a* and components forming the top of the reinforcing structure. As a result, it may be possible to reduce the dimensions and/or weight of the components in the upper parts of the reinforcing structure.

Figure 32:
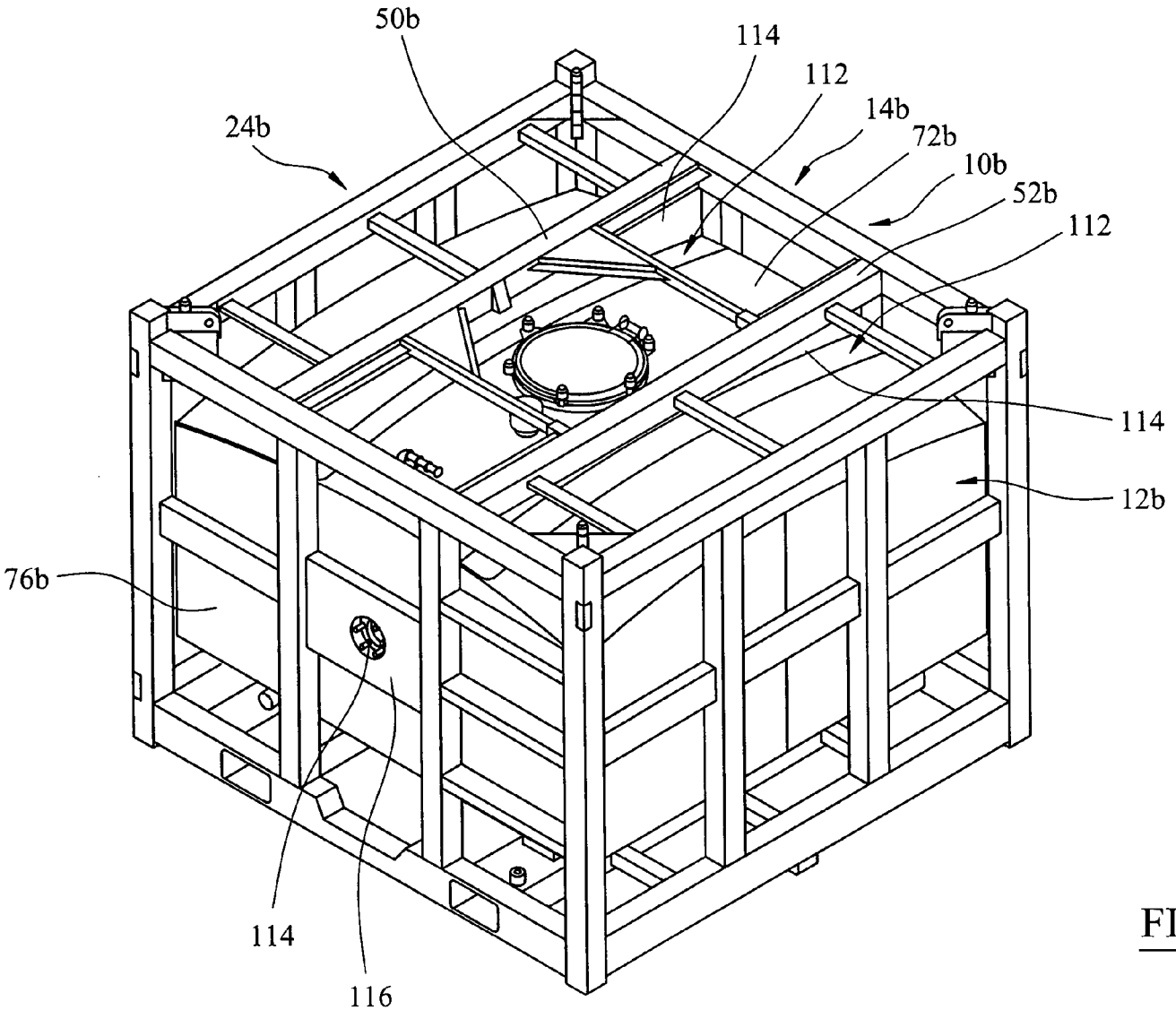
FIGS. 32 and 33 are perspective views of a tank for storing fluid in accordance with a further alternative embodiment of the present invention, taken from above and below, respectively.
Figure 33:
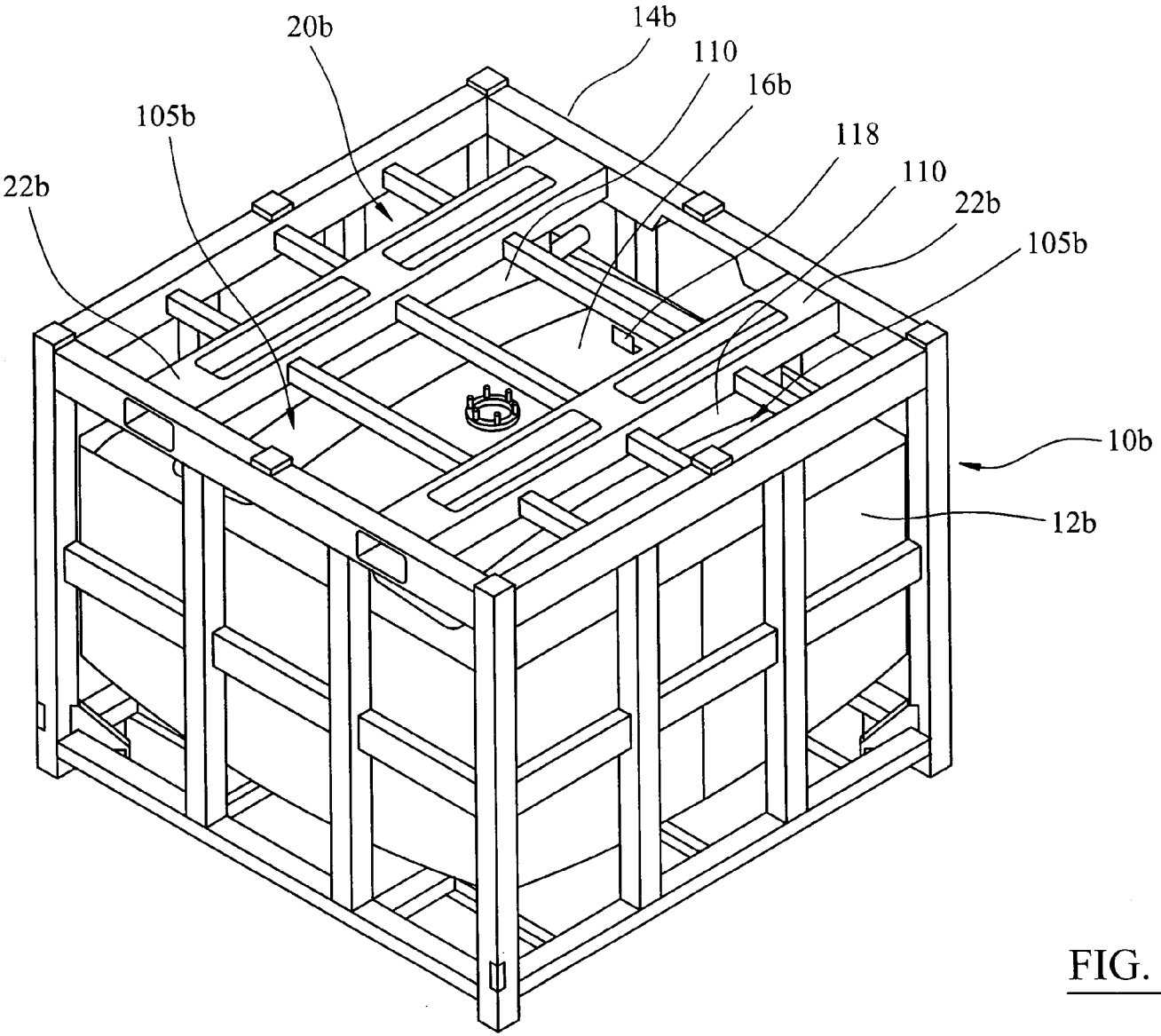

Turning now to FIGS. 32 and 33, there are shown perspective views of a tank in accordance with a further alternative embodiment of the present invention, the tank indicated generally by reference numeral 10*b*. FIG. 32 is a perspective view taken from below, and FIG. 33 is a perspective view taken from above. Like components of the tank 10*b* with the tank 10 of FIGS. 1 to 17 share the same reference numerals, with the addition of the suffix "b". The tank 10*b* is in fact most alike to the tank 10*a* of FIGS. 18 to 31, and like components of the tank 10*b* with the tank 10*a* also share the same reference numerals, with the addition of the suffix "b" or with the suffix "a" replaced by the suffix "b", where appropriate. Only the differences between the tanks 10*a* and 10*b* will be described herein in detail.

The tank 10*b* includes a vessel 12*b* mounted in a frame 14*b*. Doubler plates 105*b* (FIG. 33) are welded to a base 16*b* of the vessel 12*b*, and support elements in the form of cradles 110 are welded to the doubler plates 105*b*. The cradles 110 rest upon and are welded to cross-beams 22*b* of a base 20*b* of the frame 14*b*, and have arcuate support surfaces shaped to correspond to the shape of the base 16*b* and thus to provide support for the vessel 12*b* (particularly under applied load of a pressurised fluid in the vessel, which may cause the base 16*b* to flex outwardly). Similar doubler plates 112 (FIG. 32) are welded to a dish-shaped top 72*b* of the vessel 12*b*, and cradles 114 are welded to the doubler plates and to cross-beams 50*b* and 52*b* of a top 24*b* of the frame 14*b*. The vessel 12*b* also includes an aperture 114 in a side wall 76*b* for a level gauge (not shown), which is mounted by means of a tank pad 116. Additionally, a support bracket 118 is welded to the base 16*b* and provides a mounting for an outlet pipe and valve gear (not shown) such as the pipe and gear 66, 68 shown in FIG. 4.

The tanks described above have a particular utility in the storage and transportation of hazardous fluids, which may include noxious chemicals. One particular use for tanks of this type is in the storage and transportation of fluids for use in the oil and gas exploration and production industry. For example, the tanks can be used to transport oilfield chemicals, which may be downhole treatment fluids such as methanol or biocides. However, it will be understood that the principles of the present invention may apply to tanks used for storing fluid utilised in a wide range of industries other than the oil and gas exploration and production industry.

Various modifications may be made to the foregoing without departing from the spirit or scope of the present invention.

For example, the geometrical centre of the radius of curvature of the base may be located spaced laterally from the centre or centroid of the base, and thus not located above the centroid. The radius of curvature may be at least 3 m, and may be at least 4 m. The radius of curvature may be no more than 7 m, and may be no more than 6 m.

The base may have a non-constant radius of curvature. The radius of curvature may be non-constant in a direction extending radially from a centre or centroid of the base towards an edge of the base, and thus may vary along the length of the radius. Thus a degree of curvature of the base may be non-constant in a radial direction, and may be non-constant in all radial directions. The base may be parabolic or elliptical in cross-section. The radius of curvature may be non-constant in a direction extending around a circumference of the base, that is, along a line which extends in a circular path at a fixed radial distance from a centre or centroid of the base. Thus a degree of curvature of the base may be non-constant in a circumferential direction.

The base may comprise a first portion of a first radius of curvature and at least one further portion of a further radius of curvature which is different from said first radius of curvature. The first and further portions may have constant or non-constant radii of curvature, in a similar fashion to that described above.

The vessel base may comprise a planar portion or portions.

Side walls of the vessel may be connected to the base at lower edges of the side walls, and the side walls may be shaped to conform to the shape of the base, the lower edges of the side walls thus being curved or arcuate to permit such connection.

The dished base and/or top of the tank may be convex as shown in the drawings, but may equally be concave. This may provide enhanced strength under loading of the tank.

In further embodiments of the present invention, a tank may be provided which combines one of more of the features of one or more of the above described embodiments of the invention.

The invention claimed is:

1. A tank which can store pressurised fluids, the tank comprising:

a vessel for receiving and storing a pressurised fluid; and a reinforcing structure for the vessel, the reinforcing structure located externally of the vessel;

wherein the vessel has a generally quadrilateral shape in plan view, a base which is generally dish-shaped with an outlet located in a position which facilitates discharge of the fluid from the vessel and a generally dish-shaped top; and wherein the base and the top of the vessel are each convex and have a shape which corresponds to part of a surface of a sphere, wherein the base has a continuous curvature from the outlet to an entire perimeter of the base, to resist deformation under applied fluid pressure loading, and wherein a radius of the curvature has a geometric centre located above the vessel.

2. A tank as claimed in claim 1, in which a radius of the curvature of the base is constant in a direction extending around a circumference of the base.

3. A tank as claimed in claim 1, comprising four planar side walls.

4. A tank as claimed in claim 1, in which the outlet is located at a position which is lowermost of the base.

5. A tank as claimed in claim 4, in which the outlet is located at a centre point of the base.

6. A tank as claimed in claim 1, in which the reinforcing structure comprises a reinforcing frame having a base, a top and four sides, and in which the sides of the frame are located in abutment with corresponding side walls of the vessel.

7. A tank as claimed in claim 6, in which at least one of the base and the top of the frame abuts the vessel.

8. A tank as claimed in claim 1, in which side walls of the vessel are each shaped such that at least part of a lower edge of each side wall overlaps the corresponding edge of the base of the vessel.

9. A tank as claimed in claim 8, in which edges of the base extend up inner surfaces of the side walls.

10. A tank as claimed in claim 1, wherein a radius of the curvature of the base is from 3 to 5 meters.

11. A tank which can store pressurised fluids, the tank comprising:

a vessel for receiving and storing a pressurised fluid; and a reinforcing structure for the vessel, the reinforcing structure located externally of the vessel;

wherein the vessel has a generally quadrilateral shape in plan view, a base which is generally dish-shaped with an outlet located in a position which facilitates discharge of the fluid from the vessel and a generally dish-shaped top; and wherein the base and the top of the vessel are each convex and have a shape which corresponds to part of a surface of a sphere, wherein the base has a continuous curvature from the outlet to edges of the base and wherein a radius of the curvature has a geometric centre located above the vessel, to resist deformation under applied fluid pressure loading;

the tank further comprising doubler plates welded to the base of the vessel, and wherein the reinforcing structure comprises a reinforcing frame having a base with cross-beams and cradles resting upon and welded to the cross-beams, the cradles being welded to the doubler plates and having arcuate support surfaces which are shaped to correspond to the shape of the base to provide support for the vessel under the applied load of a pressurised fluid in the vessel.

12. A tank which can store pressurised fluids, the tank comprising:

a vessel for receiving and storing a pressurised fluid; and a reinforcing structure for the vessel, the reinforcing structure located externally of the vessel;

wherein the vessel has a generally quadrilateral shape in plan view, a base which is generally dish-shaped with an outlet located in a position which facilitates discharge of the fluid from the vessel and a generally dish-shaped top;

wherein the base and the top of the vessel are each convex and have a shape which corresponds to part of a surface of a sphere, to resist deformation under applied fluid pressure loading;

the tank further comprising doubler plates welded to the base of the vessel, and wherein the reinforcing structure comprises a reinforcing frame having a base with cross-beams and cradles resting upon and welded to the cross-beams, the cradles being welded to the doubler plates and having arcuate support surfaces which are shaped to correspond to the shape of the base to provide support for the vessel under the applied load of a pressurised fluid in the vessel;

the tank further comprising doubler plates welded to the top of the vessel, and wherein the reinforcing frame has a top with cross-beams and cradles welded to the cross-beams, the cradles being welded to the doubler plates and having arcuate support surfaces which are shaped to correspond to the shape of the top to provide support for the vessel under the applied load of a pressurised fluid in the vessel.

13. A tank which can store pressurised fluids, the tank comprising:

a vessel for receiving and storing a pressurised fluid; and a reinforcing structure for the vessel, the reinforcing structure located externally of the vessel;

wherein the vessel has a generally quadrilateral shape in plan view, a base which is generally dish-shaped with an outlet located in a position which facilitates discharge of the fluid from the vessel and a generally dish-shaped top; and wherein the base and the top of the vessel are each convex and have a shape which corresponds to part of a surface of a sphere, wherein the base has a constant curvature from the outlet to an entire perimeter of the base, to resist deformation under applied fluid pressure loading, and wherein a radius of the curvature of the base is constant in a direction extending radially from the outlet of the base towards the perimeter of the base.

14. A tank as claimed in claim 13, in which a geometrical centre of the radius of curvature is located vertically above a centre point of the base.

15. A tank as claimed in claim 13, in which a geometrical centre of the radius of curvature is spaced laterally from a line extending vertically from a centre point of the base.

16. A tank as claimed in claim 13, wherein the radius of the curvature has a geometric centre located above the vessel.

17. A tank which can store pressurised fluids, the tank comprising:

a vessel for receiving and storing a pressurised fluid, the vessel comprising doubler plates welded to a base of the vessel;

a reinforcing structure for the vessel, the reinforcing structure located externally of the vessel and comprising a reinforcing frame having a base, a top and four sides, and in which the sides of the frame are located in abutment with corresponding side walls of the vessel;

wherein the base of the reinforcing frame comprises cross-beams and cradles resting upon and welded to the cross-beams, the cradles being welded to the doubler plates and having arcuate support surfaces which are shaped to correspond to the shape of the base to provide support for the vessel under the applied load of a pressurised fluid in the vessel;

wherein the vessel has a generally quadrilateral shape in plan view, a base which is generally dish-shaped with an outlet located in a position which is lowermost of the base to facilitate discharge of the fluid from the vessel, and a generally dish-shaped top;

wherein the base and the top of the vessel are each convex and have a shape which corresponds to part of a surface of a sphere, to resist deformation under applied fluid pressure loading;

wherein a radius of curvature of the base is constant in a direction extending radially from a centre of the base towards an edge of the base; and wherein the side walls of the vessel are each shaped such that at least part of a lower edge of each side wall overlaps a corresponding edge of the base of the vessel.

18. A tank as claimed in claim 17, comprising doubler plates welded to the top of the vessel, and wherein the reinforcing frame has a top with cross-beams and cradles welded to the cross-beams, the cradles being welded to the doubler plates and having arcuate support surfaces which are shaped to correspond to the shape of the top to provide support for the vessel under the applied load of a pressurised fluid in the vessel.

19. A tank as claimed in claim 17, comprising four planar side walls.

20. A tank as claimed in claim 17, in which edges of the base extend up inner surfaces of the side walls.

* * * * *